US007404213B2

(12) United States Patent
Lieberman

(10) Patent No.: US 7,404,213 B2
(45) Date of Patent: Jul. 29, 2008

(54) CONVERTIBLE WET SUIT

(76) Inventor: Seth Lieberman, 27 Prince St., Jamaica Plain, MA (US) 02130

( * ) Notice: Subject to any disclaimer, the term of this patent is extended or adjusted under 35 U.S.C. 154(b) by 12 days.

(21) Appl. No.: 11/546,567

(22) Filed: Oct. 12, 2006

(65) Prior Publication Data

US 2008/0109926 A1 May 15, 2008

(51) Int. Cl.
*B63C 11/04* (2006.01)

(52) U.S. Cl. ..... 2/2.15; 2/2.16; 2/2.17

(58) Field of Classification Search ..... 2/2.15, 2/2.17, 126

See application file for complete search history.

(56) References Cited

U.S. PATENT DOCUMENTS 1,147,155 A * 7/1915 Farlow ..... 2/126
1,489,046 A * 4/1924 Thompson ..... 2/114
1,505,053 A * 8/1924 Millhauser ..... 2/90
2,099,431 A * 11/1937 Reeb ..... 2/126
2,147,054 A * 2/1939 Pearson ..... 2/125
2,313,519 A * 3/1943 Cuttler ..... 2/97
2,677,131 A * 5/1954 Shuster ..... 2/126
4,006,495 A * 2/1977 Jones ..... 2/93
4,068,316 A * 1/1978 Haywood ..... 2/126
4,261,059 A * 4/1981 Spitz ..... 2/108
4,302,850 A * 12/1981 Maeshima ..... 2/102
4,347,629 A * 9/1982 Itoi ..... 2/108
4,356,570 A * 11/1982 Vernon et al. ..... 2/16
4,862,517 A 9/1989 Meistrell
4,999,850 A * 3/1991 Grilliot et al. ..... 2/126
5,023,953 A * 6/1991 Bettcher ..... 2/126
5,073,988 A 12/1991 Lewis, Jr. et al.
5,088,116 A * 2/1992 Gould ..... 2/82
5,159,716 A * 11/1992 Takata ..... 2/2.16
5,191,658 A 3/1993 Meistrell
5,201,075 A * 4/1993 Svetich ..... 2/108
5,628,064 A * 5/1997 Chung ..... 2/70
5,673,836 A * 10/1997 Bush ..... 224/576
5,717,999 A * 2/1998 Lurry ..... 2/69
5,894,600 A * 4/1999 Chenefront ..... 2/69
6,047,404 A * 4/2000 Blanks, I ..... 2/69
6,298,485 B1 * 10/2001 Heller ..... 2/70
6,473,904 B2 11/2002 Long (Continued)

*Primary Examiner*—Gary L. Welch
*Assistant Examiner*—Bobby H Muromoto, Jr.
(74) *Attorney, Agent, or Firm*—Roberts Mlotkowski Safran & Cole, P.C.; Thomas W. Cole

(57) ABSTRACT

A convertible wet suit system is provided that includes a torso fitting portion having tubular, partial limb coverings that terminate in first end portions, extended limb coverings having second end portions, and a coupling assembly for detachably connecting the first and second end portions. The coupling assembly includes a slide fastener that only partially circumscribes the first and second end portions, and at least one VELCRO® or snap-type fastener that detachably connects only part of the region between the first and second end portions that is uncircumscribed by the slide fastener such that some areas of the end portions remain unconnected when the coupling assembly is joined. Such unconnected areas between the first and second end portions advantageously maintain the elastomeric flexibility of the wet suit in the area of the coupling assembly. Additionally, the extended limb coverings may be formed from a sheet material having a different thickness than the sheet material forming the torso fining portion to enable the user to customize the warming ability of the wet suit to a broad variety of water temperatures and conditions.

12 Claims, 3 Drawing Sheets

U.S. PATENT DOCUMENTS 6,654,968 B2 * 12/2003 Braun et al. ..... 2/269
6,675,389 B1 * 1/2004 Kublick ..... 2/2.17
7,028,342 B1 * 4/2006 Nordstrom et al. ..... 2/119
2005/0005337 A1 1/2005 Yokoyama

* cited by examiner

CONVERTIBLE WET SUIT

TECHNICAL FIELD

This invention generally relates to a convertible wet suit, and specifically concerned with a convertible wet suit having a joint assembly formed from a zipper that only partially circumscribes the joint area that detachably connects long sleeves and leggings to the short sleeves and short legs of the suit.

BACKGROUND OF THE INVENTION

Convertible wet suits are known in the prior art. Such wet suits allow the user to convert a full length wet suit into a short-length wet suit, and vice versa, in accordance with ambient water temperature conditions.

All such convertible wet suits require some sort of joint mechanism for detachably joining an extended sleeve or legging to a short sleeve or short legging. One common type of prior-art joint structure is the provision of a 360 degree zipper surrounding the interface between the short sleeves and short leggings of the wet suit and the detachably connectible extended sleeves and leggings. In another prior art design, a zipper is provided along the longitudinal axis of the short sleeves and short legs of the wet suit so that the outer ends of the short sleeves and legs may be widened to receive a coupling portion of the extended sleeves and leggings, and then closed around the coupling portion.

Unfortunately, such prior art joint designs are not without shortcomings. While a joint structure that employs a 360 degree zipper provides a secure coupling between the limb covering components of the wet suit, the inherent inelasticity of the two opposing strips of intermeshing teeth that form such zippers interferes with the ability of the wet suit to stretch at the joint areas, which in turn obstructs the ability of the wet suit to conform to the body shape of the wearer. Hence many wearers of the full size version of such wet suits may have difficulty putting on the wet suit due to the loss of flexibility in the joint areas caused by the zippers. Additionally a muscular person may experience an uncomfortable pressure around the joints of the wet suit. Conversely, a thinner person may experience an uncomfortable amount of slack area around the joints of the wet suit which in turn might promote the accumulation of too much water in the joint areas, thereby chilling the wearer.

While the second prior art joint design that utilizes longitudinally-oriented zippers can successfully maintain elasticity in the joint areas if the coupling portions are made from, for example, neoprene, the full size version of such a suit must be assembled over the body of the user. The resulting necessity of pulling each long sleeve and legging over each arm and leg of the user and positioning the coupling portions so that they overlap with the end portions of the short sleeves and legs is a troublesome and time consuming operation for the wearer as the user must remove or put on five pieces of the suit instead of one single suit. Additionally, the resulting overlapping coupling is less secure than the 360 degree zipper type joint and is therefore prone to leakage and being inadvertently pulled apart. If the coupling portions are made of a more rigid material to obviate the need for the wearer to assemble the full size suit over his own body, the elasticity of the resulting joints is substantially reduced, creating the same problems as the previously discussed convertible wet suit utilizing 360 degree zippers.

Clearly, what is needed is a convertible wet suit having a joint structure which provides a secure coupling between the components of the wet suit while maintaining the elasticity of the suit in the joint areas. Ideally, such a joint structure should allow the wearer to easily and quickly convert the suit from a short suit to a long suit, and vice versa, without the need for assembling the full size suit on his own body. Finally, such a joint structure should effectively discourage leakage of ambient water into the suit so that the warming characteristics of the suit are not compromised.

SUMMARY OF THE INVENTION

Generally speaking, the invention is a convertible wet suit that overcomes or ameliorates all of the aforementioned shortcomings associated with the prior art. To this end, the convertible wet suit of the invention comprises a torso fitting portion having tubular, partial limb coverings that terminate in first end portions, extended limb coverings having second end portions, and a coupling assembly for detachably connecting the first and second end portions. The coupling assembly includes a slide fastener that only partially circumscribes the first and second end portions, and a plurality of discrete fasteners that detachably connect only selected points of the region between the first and second end portions that is uncircumscribed by the slide fastener. The provision of a coupling assembly that leaves unconnected areas between the discrete fasteners when the first and second ends are joined advantageously preserves the elasticity of the wet suit in the region of the joint while providing a secure coupling between the partial limb coverings and the extended limb coverings.

The slide fastener may be a standard, zipper-type fastener formed from two strips of flexible teeth which may be intermeshed or disengaged into a fastened or unfastened relationship by means of a slider. Alternatively, the slide fastener may include two strips of intermeshable spline which likewise may be connected or disconnected by means of a zipper-type slider. Preferably, the slide fastener circumscribes between about 30% and 70% of the circumference of the first and second end portions, and more preferably between about 40% and 60% of the circumference A plurality of discrete fasteners is used to join the region of the first and second end portions that are uncircumscribed by the slide fastener. The discrete fasteners may be VELCRO®-type fasteners formed from a pair of interengagable hook and eye pads. The discrete fasteners not only serve to complete a joint between the first and second end portions of the partial and extended limb coverings; they also function to align the two halves of the slide fastener during the joining of the coupling assembly so that the slide fastener may be easily closed to complete the joint.

Finally, the coupling assembly includes a collar of flexible material that is connected around the inner surface of the first end portions of the partial limb covers. One of the strips of flexible teeth is connected to the collar so that the zipper does not come into contact with the skin of the wearer. Additionally, the collar advantageously provides a water seal around the end portions of the partial limb coverings and an additional layer underneath the coupling joint.

The convertible wet suit of the invention may easily and quickly be converted from a short suit to a "full" suit by first securing the discrete fasteners of each of the coupling assemblies (which serves not only to partially join the extended limb coverings with the partial limb coverings of the torso covering portion, but also advantageously aligns the two halves of the non-360 degree zippers) and then securing the zippers of the coupling assemblies. The resulting single piece "full" wet suit is then easily donned by the wearer due to the flexibility maintained in the joint areas by the non-360 degree zippers.

In addition to the aforementioned coupling assembly, the invention also encompasses a convertible wet suit system, wherein the thickness of the sheet material forming the extended limb coverings may be chosen to be different from the thickness of the sheet material forming the torso fitting portion. Such a convertible wet suit system advantageously provides the user with the ability to customize the thickness of the wet suit to different water temperature conditions. Hence, the user is given the flexibility of assembling a wet suit with extended limb coverings formed from a sheet material that is thinner than the sheet material that forms the torso fitting portion in a situation where a "full" wet suit is desired, but the water temperature is too warm for a wet suit formed from uniformly thick sheet material.

DETAILED DESCRIPTION OF THE PREFERRED EMBODIMENT

Figure 1:
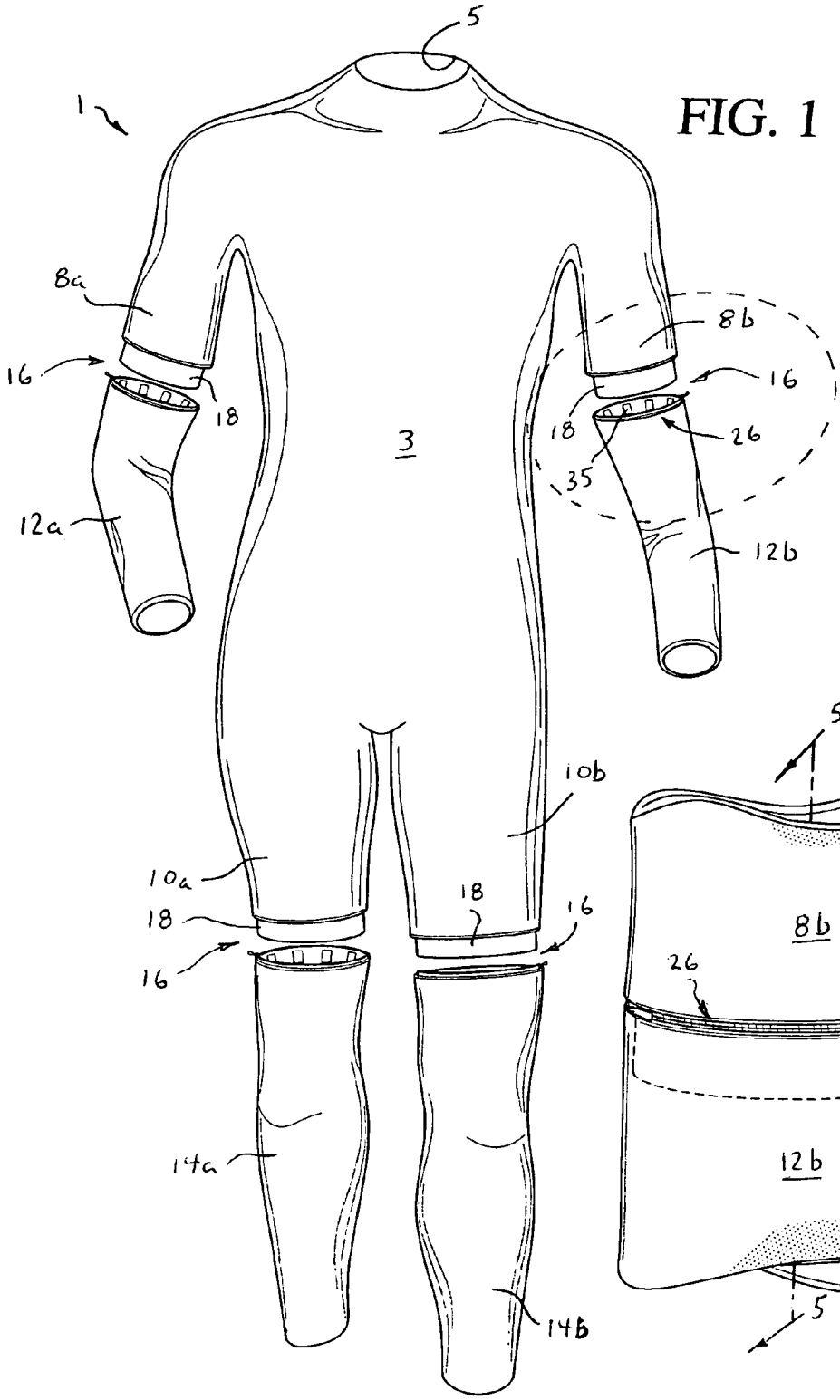
FIG. 1 is a front, perspective view of the convertible wet suit of the invention.
Figure 2:
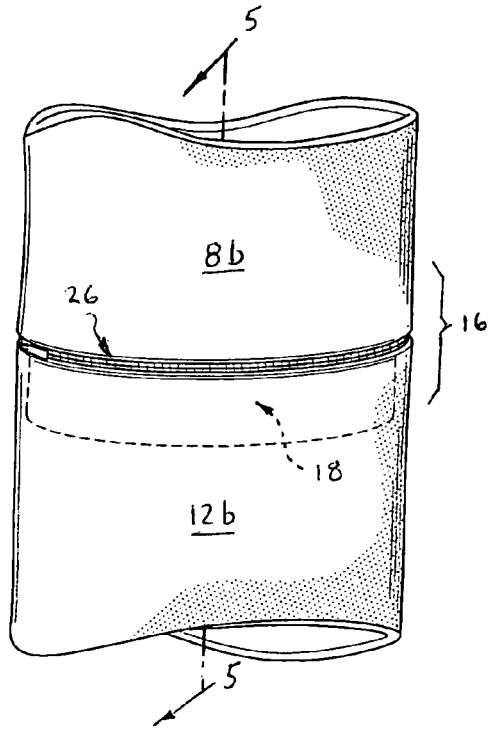
FIG. 2 is an enlargement of the area circled in phantom of FIG. 1, illustrating the coupling assembly in a connected state.

With reference to FIGS. 1 and 2, wherein like components are designated by like reference numerals throughout all the several figures, the convertible wet suit 1 of the invention includes a torso-fitting portion 3 formed from an elastomeric sheet material such as neoprene or polychloroprene. The torso-fitting portion 3 includes a neck opening 5, and a zipper 6 that extends along the back to allow a wearer to easily put on or take off the wet suit 1. The torso-fitting portion 3 includes partial limb coverings in the form of short sleeves 8*a*, 8*b* and leg shorts 10*a*, 10*b*. Each of these partial limb coverings terminates in an end portion 11. The convertible wet suit 1 further includes extended, tubular limb coverings in the form of long sleeves 12*a*, 12*b*, and leggings 14*a*, 14*b*. Each of these extended limb coverings has an end portion 15 which, as will be described in more detail hereinafter, is detachably connectible to the end portion 11 of the partial limb coverings.

A coupling assembly 16 detachably connects the partial limb coverings to the extended limb coverings. To this end, coupling assembly 16 includes an annular, ring-shaped portion of neoprene sheet material in the form of a collar 18 that is mounted around the inner surface of each of the end portions 11 of the short sleeves 8*a*, 8*b* and leg shorts 10*a*, 10*b*.

Figure 3:
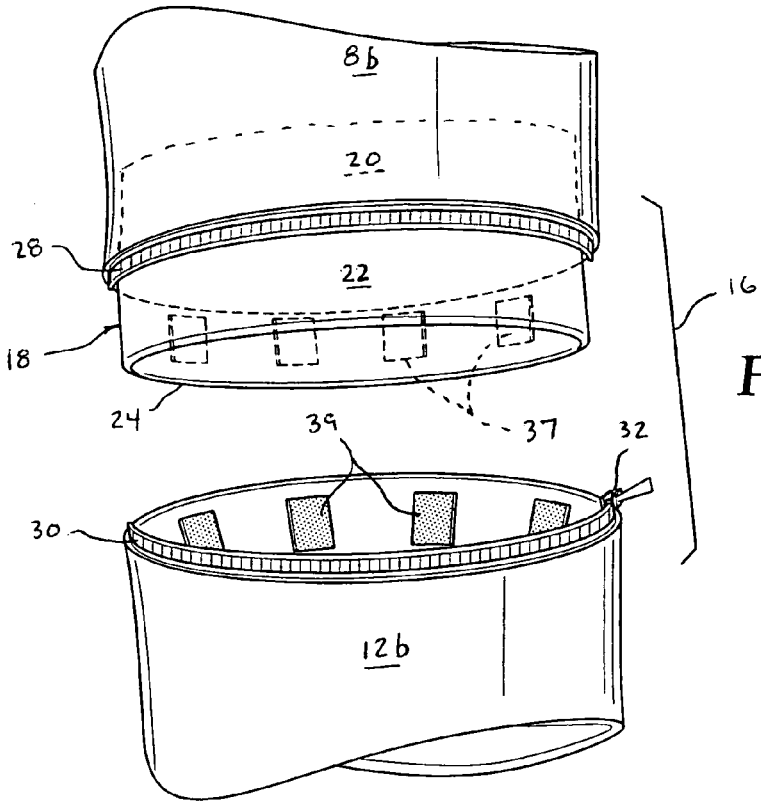
FIGS. 3 and 4 are front and back perspective views of the coupling assembly of the wet suit in a disconnected state.
Figure 4:
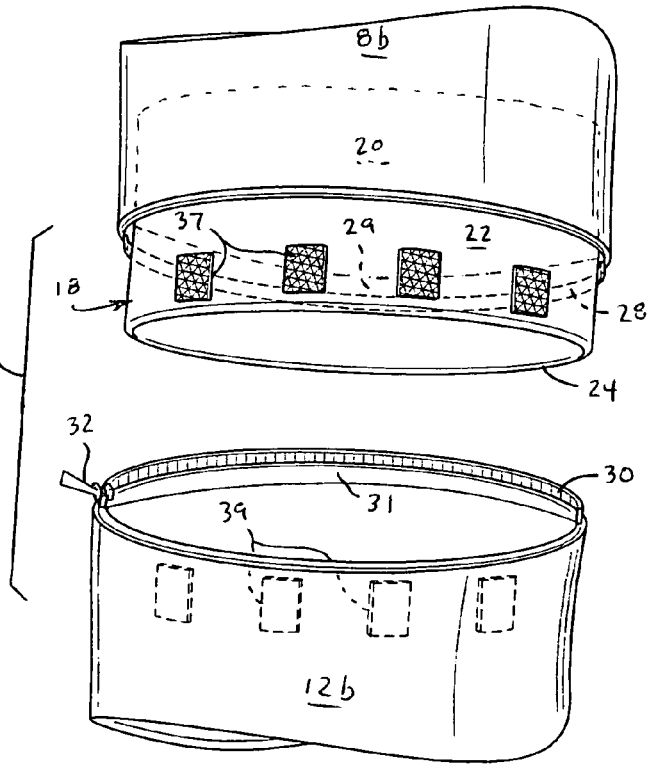

With reference now to FIGS. 3 and 4, the collar 18 includes an upper section 20 that circumscribes the inner surface of the end portion 11, and a lower section 22 that protrudes away from the end portion 11. The lower section 22 of the collar 18 terminates in a beveled or rounded edge 24. While the upper section 20 of the collar 18 may be secured around the inner surface of the end portion 11 in a number of ways, stitching is used in the preferred embodiment.

Coupling assembly 16 further includes a zipper 26 that only partially circumscribes the joint. In the preferred embodiment, the zipper 26 circumscribes only between about 40 and 60 percent of the circumference of the end portions 11 and 15. The zipper 26 is preferably positioned around the front side of the wet suit 1 for both the convenience of the wearer in attaching or removing the long sleeves 12*a*, 12*b* or leggings 14*a*, 14*b*, and further for esthetic reasons, as the closed zippers 27 give the long form of the wet suit a more streamlined appearance than if the unzippered portion of the coupling assembly 16 were exposed. While the zipper 26 may circumscribe a lesser or greater percentage of the circumference of the end portions 11 and 15 than 30% and 70%, the 30%-70% range is preferred as such a percentage range has been found to provide an optimal compromise between joint integrity, flexibility, convenience, and esthetic appearance.

As is best seen in FIG. 3, zipper 26 includes two, strip-shaped flexible halves 28 and 30 each of which includes a row of teeth which are interengagable by means of a slider 32. Each of the two halves 28, 30 includes a support strip 29, 31 (shown in FIG. 5) which is attached to the end portions 11 and 15 via stitching. The top halves 28 of the zipper 26 are the "male" halves, while the bottom halves 30 are the "female" halves which include the slider 32 that receives an end of the male half. Hence the "Male" halves 28 are attached to the end portions 11 of the short sleeves 8*a*, 8*b* and leg shorts 10*a*, 10*b*, while the "female" halves 30 are attached to the long sleeves 12*a*, 12*b* and leggings 14*a*, 14*b*. Such an arrangement allows the wearer to wear the wet suit 1 in its "short" form without the presence of the sliders 32 which serve no useful purpose except when the long sleeves 12*a*, 12*b* and leggings 14*a*, 14*b* are joined to the torso-fitting portion 3. The teeth of the zipper 26 are preferably formed from nylon or some other non-corrosive material. Alternatively, the combination of interconnectible splines may be used in lieu of a zipper 26 of the type that uses interengagable teeth. Generally, any type of sliding fastener is encompassed within the scope of this invention.

With reference again to FIGS. 3 and 4, the coupling assembly 16 also includes a plurality of discrete fasteners in the form of VELCRO® fasteners 35. Each of these fasteners 35 includes a hook pad 37 and a loop pad 39 which may be engaged by pressure and disengaged simply by pulling apart. The hook and loop pads 37, 39 are preferably uniformly spaced around the portion of the coupling 16 that is uncircumscribed by the zipper 26 so as to create areas 40 between the end portions 11 and 15 which remain unconnected when the coupling assembly 16 is joined together. The unconnected areas 40 maintain the elasticity of the wet suit 1 in the joint formed by the coupling assembly 16.

Figure 5:
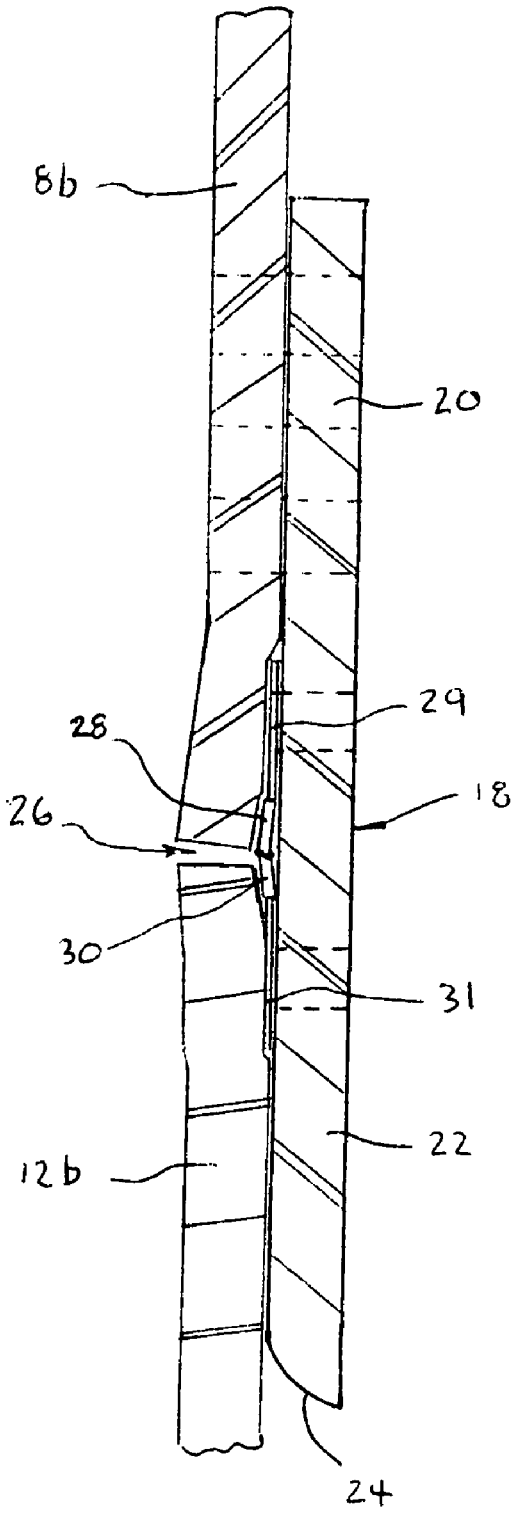
FIG. 5 is a cross sectional view of the coupling assembly along the line 5-5 shown in FIG. 2.

With reference now to FIG. 5, the "male" half 28 of the zipper 26 of each coupling assembly 16 is mounted on the upper section of the collar so that it is substantially covered by the edge 40 of the end portion 11. This feature is not shown in FIGS. 2-4 in order that the components of the zipper 26 may be easily seen. Similarly, the "female" half 30 of the zipper 26 is mounted around the inner surface of the edge 42 of the end portion 15. In both cases, the support strips 29, 31 of the zipper halves 28, 30 are stitched to the sheet material forming the edges 40, 42. Such construction enhances the aesthetics of the wet suit in both its short and long forms, as it renders the components of the zipper 26 inconspicuous.

In operation, when the user wishes to convert the torso fitting portion 3 into a full wet suit 1, all he has to do is to attach the VELCRO® fasteners 35 of the coupling assembly 16 of the particular long sleeve 12*a*, 12*b* or legging 14*a*, 14*b* being connected, and then secure the zipper 26 of the coupling assembly 16. After this process has been completed for all four extended limb portions, the user simply puts on the resulting full length wet suit, which is facilitated by the flexibility maintained in each of the joint areas as a result of the non-360 degree zippers 26.

The invention further comprises a wet suit system wherein the long sleeves 12*a*, 12*b* and/or leggings 14*a*, 14*b* may be formed from a sheet material having a different thickness than the torso-fitting portion 3. For example, if the thickness of the neoprene or other sheet material forming the torso-fitting portion is 3 millimeters, the system of the invention will allow the wearer to choose long sleeves 12*a*, 12*b* and/or leggings 14*a*, 14*b* which are formed from sheet material having thicknesses of 3 millimeters, 2 millimeters, or 1 millimeter. A 1 millimeter thickness may be chosen for the long sleeves 12*a*, 12*b* and leggings 14*a*, 14*b* in a situation where the water temperature is such as to justify the wearing of a "full" wet suit but not so cold as to justify the wearing of such a wet suit uniformly formed from a sheet material of 3 millimeters in thickness. Accordingly, the system of the invention provides the wearer with the ability to custom-assemble a wet suit having an appropriate thickness (and hence an appropriate insulating ability) over a broad range of water temperatures and ambient conditions.

While this invention has been described with respect to a preferred embodiment, various modifications and additions will become evident to persons of ordinary skill in the art. All such additions, variations and modifications are encompassed within the scope of this invention, which is limited only by the appended claims and their equivalence.

What is claimed is:

1. A convertible wet suit, comprising:

a torso fitting portion having at least one tubular, partial limb covering that terminates in a first end portion formed from elastomeric sheet material;

at least one tubular, extended limb covering having a second end portion formed from elastomeric sheet material, and a coupling assembly for detachably connecting said first and second end portions, including a slide fastener means that only partially circumscribes said first and second end portions for maintaining circumferential elasticity in the elastomeric sheet material forming said first and second end portions, and at least one discrete fastener means that detachably connects only part of the area between the first and second end portions that is uncircumscribed by said slide fastener, for connecting said first and second end portions while maintaining circumferential elasticity in the elastomeric sheet material forming said first and second end portions.

2. A convertible wet suit according to claim 1, wherein said slide fastener means has first and second fastener portions that are selectively interconnectable by a slider, and are affixed to said first and second end portions, respectively, and said at least one discrete fastener means also functions to align said first and second fastener portions to allow said slider to interconnect them.

3. A convertible wet suit according to claim 1, wherein said discrete fastener means is pressure operated.

4. A convertible wet suit according to claim 3, wherein said discrete fastener means is a hook and loop-type fastener.

5. A convertible wet suit according to claim 1, wherein said slide fastener means circumscribes between about 30% and 70% of the circumference of said first and second end portions.

6. A convertible wet suit according to claim 1, wherein one or the other of said first and second end portions includes an annular portion of elastomeric sheet material that covers an inside surface of said slide fastener means such that said slide fastener means does not come into direct contact with the skin of a wearer of said wet suit.

7. A convertible wet suit according to claim 1, wherein said torso fitting portion is formed from elastomeric sheet material having a substantially uniform thickness, wherein said extended limb coverings are formed from elastomeric sheet material having a substantially uniform thickness that is different from the thickness of said elastomeric sheet material forming said torso fitting portion.

8. A convertible wet suit according to claim 1, wherein said slide fastener means is a zipper.

9. A convertible wet suit according to claim 1, further comprising between one and six discrete fastener means.

10. A convertible wet suit according to claim 9, wherein said discrete fastener means are substantially uniformly spaced apart from one another around an inner circumference of said end portions.

11. A convertible wet suit according to claim 1, wherein said slide fastener means only partially circumscribes said first and second end portions at a front side of said wet suit relative to a person wearing said wet suit.

12. A convertible wet suit according to claim 1, wherein said partial and extended limb coverings are both formed from an elastomeric sheet material.

* * * * *